US008167446B2

(12) United States Patent
Wesselmeier

(10) Patent No.: US 8,167,446 B2
(45) Date of Patent: May 1, 2012

(54) SPOTLIGHT AND WATER FOUNTAIN

(75) Inventor: Reinhardt Wesselmeier, Hörstel-Riesenbeck (DE)

(73) Assignee: OASE GmbH, Hörstel-Riesenbeck (DE)

( * ) Notice: Subject to any disclaimer, the term of this patent is extended or adjusted under 35 U.S.C. 154(b) by 76 days.

(21) Appl. No.: 12/142,833

(22) Filed: Jun. 20, 2008

(65) Prior Publication Data

US 2009/0154163 A1 Jun. 18, 2009

(30) Foreign Application Priority Data

Jun. 21, 2007 (DE) ..... 10 2007 029 080

(51) Int. Cl.
*F21V 33/00* (2006.01)

(52) U.S. Cl. ..... 362/101; 362/96

(58) Field of Classification Search ..... 362/96, 362/101; 239/18, 19, 20, 21, 22, 23
See application file for complete search history.

(56) References Cited

U.S. PATENT DOCUMENTS

| | | | | |
|---|---|---|---|---|
| 4,088,880 | A * | 5/1978 | Walsh | 362/96 |
| 4,920,465 | A * | 4/1990 | Sargent | 362/96 |
| 5,207,499 | A * | 5/1993 | Vajda et al. | 362/96 |
| 6,917,143 | B2 * | 7/2005 | Matsui et al. | 313/35 |
| 7,300,187 | B2 * | 11/2007 | Huang et al. | 362/373 |
| 7,314,291 | B2 * | 1/2008 | Tain et al. | 362/294 |
| 7,427,036 | B2 * | 9/2008 | Skluzacek et al. | 239/18 |
| 7,533,906 | B2 * | 5/2009 | Luettgen et al. | 285/146.1 |
| 2006/0176686 | A1 | 8/2006 | McVicker | |
| 2006/0243819 | A1 | 11/2006 | Beidekhti | |
| 2007/0008713 | A1 | 1/2007 | Doyle | |
| 2007/0097675 | A1 | 5/2007 | Koren | |
| 2007/0189012 | A1 * | 8/2007 | Huang et al. | 362/294 |
| 2007/0230194 | A1 | 10/2007 | Vilarrasa | |

FOREIGN PATENT DOCUMENTS

| | | | |
|---|---|---|---|
| DE | 4327199 | A1 | 2/1995 |
| DE | 20304520 | U1 | 7/2003 |
| DE | 10238171 | A1 | 3/2004 |
| DE | 202004013536 | U1 | 10/2004 |
| DE | 202004015830 | U1 | 1/2005 |
| DE | 10338885 | A1 | 3/2005 |
| DE | 202004016297 | U1 | 5/2005 |
| DE | 202005011205 | U1 | 9/2005 |
| DE | 102005040185 | A1 | 1/2007 |
| DE | 202007012249 | U1 | 10/2007 |
| ES | 1062487 | U | 6/2006 |
| FR | 2869389 | A | 10/2005 |
| WO | 2007062455 | A1 | 6/2007 |

* cited by examiner

*Primary Examiner* — William Carter
(74) *Attorney, Agent, or Firm* — Gudrun E. Huckett

(57) ABSTRACT

The invention concerns a spotlight for use in bodies of water. The spotlight has at least one lighting unit for illuminating fountains, water jets or the like, wherein the lighting unit is liquid-cooled and has at least one light emitting diode or a light emitting diode cluster arranged in the housing.

20 Claims, 7 Drawing Sheets

SPOTLIGHT AND WATER FOUNTAIN

BACKGROUND OF THE INVENTION

The present invention concerns a spotlight for use in bodies of water, in particular as a part of a water fountain, comprising at least one lighting unit for illuminating fountains, water jets or the like. Moreover, the invention concerns a water fountain with a jet pipe for generating a fountain.

In the prior art water fountains are known that have fountains illuminated by spotlights that are individually arranged about the jet. These spotlights are positioned underneath the water surface in order to enable cooling by means of the water of the spotlights that will become hot. This means a loss of luminous intensity for the illumination of the fountain above the water level, which fountain can be comprised of one or several water jets.

It is an object of the present invention to improve the disadvantageous prior art and in particular to provide a spotlight for use in wet areas or in the field of bodies of water and a corresponding water fountain which provide sufficient luminous intensities and have at the same time a compact size.

SUMMARY OF THE INVENTION

The object is solved by a spotlight that has a liquid-cooled lighting unit that comprises at least one light emitting diode arranged in the housing. The object is further solved by a water fountain comprising a spotlight according to the invention that is arranged in the same housing for providing at least external illumination of the fountain. Advantageous embodiments are disclosed in the dependent claims, respectively.

By using light emitting diodes, LEDs, or preferably LED clusters with high luminous intensity a spotlight according to the present invention can be built that has minimal energy consumption and minimal heat development. At the same time, such a spotlight is of a more compact size. In order to dissipates the heat developed by a plurality of light emitting diodes, also referred to as LEDs, the spotlight is designed to be liquid-cooled, i.e., it comprises a lighting unit that is liquid-cooled.

The spotlight according to the invention comprises at least one lighting unit comprised of at least one electronic control unit and at least one LED as well as its housing together with a stand to be provided.

The spotlight must no longer be arranged mostly below the water surface; it can also be arranged, at least partially with its light emitting area, above the water surface so that the luminous intensity that is available can be used fully. Accordingly, the number of required LEDs is reduced. The more precise control and the optimal controllability of the diodes improve at the same time the energy utilization. In addition, the water surfaces can also be illuminated from above. By means of at least one LED cluster that is arranged in the housing of the spotlight especially it is possible to generate high luminous intensities with a great number of different control possibilities and the resulting variability of the illumination. Advantageously, these LED clusters are provided with LEDs of different colors, for example, the three primary colors.

The spotlight according to the invention is more compact when the light emitting diodes are arranged in an advantageous embodiment on a common circuit board. This simplifies the construction and also the control of the spotlight. A common circuit board that is preferably a liquid-cooled circuit board provides furthermore a uniform distribution of heat in the housing so that the heat can be dissipated well. The light emitting diodes are preferably uniformly distributed across a cross-sectional surface area of the housing, for example, in an annular arrangement.

Advantageously, a plate is arranged on the circuit board which plate is heat-conducting and thus provides an excellent heat dissipation of the heat produced by the lighting unit. In order to improve heat dissipation the circuit board is preferably connected by means of heat conductive paste to the plate. A metal plate is particularly advantageous when the lighting unit already generates heat immediately after being switched on while a cooling medium is not yet supplied to the spotlight. In this case, the metal plate acts as an intermediate storage in order to intermediately store the produced heat until it can be transferred to a cooling medium so that damage of the lighting unit is prevented.

As an alternative or as a supplement the circuit board and/or a metal plate delimiting the circuit board on one side is provided with a side that delimits a cooling channel so that the circuit board and/or the plate is liquid-cooled directly.

In another preferred embodiment of the invention the spotlight has not only one but several cooling water outlets so that the cooling medium introduced into the housing after absorbing heat is conveyed on a direct path that is as short as possible out of the housing without dissipating the absorbed heat into other areas of the housing. As a cooling medium in the different embodiments of the invention preferably the water of the body of water or the pond is used in which the spotlight is installed for illuminating a fountain.

A spotlight according to the invention is improved in particular by an embodiment with a cooling module arranged in a central area. The spotlight is thus directly cooled from one area and directly in this area in which otherwise the highest temperatures would be present. The heat is uniformly dissipated from all areas of the preferably circular housing.

The arrangement of a cooling medium inlet opening and outlet opening in a central lower area of the housing is advantageous for an inconspicuous installation of the spotlight in particular in water wherein the cooling medium supply preferably is designed to be sufficiently rigid in order to be used as a stand for the spotlight. For this purpose, the cooling liquid supply can be provided for example with a flange on which a holder, preferably a ball-and-socket joint, can be attached; this enables a variable orientation of the spotlight.

The ball itself is to be arranged on an appropriate stand that is positioned for example in a body of water or a pond. The arrangement of a cooling liquid outlet opening in a central, in particular lower, area of the housing in combination with a cooling liquid inlet opening arranged in the same area assists in using a cooling module that can be inserted in a modular fashion into the spotlight. At the same time, supply and removal can be arranged for example in a single hose or pipe.

Advantageous is also a configuration according to the invention with a central supply hose or pipe along which the heated cooling liquid then flows into the environment. The heat is then dissipated directly into the lower environment of a spotlight, for example, directly into the surrounding water, and the supply is covered by the exiting cooling liquid.

In order to not only cool the circuit board but also other areas of the spotlight, it is advantageous when the cooling module comprises a cooling head that projects into the lighting unit. The cooling head is preferably made of metal so that it can absorb well the heat present above the circuit board and can transfer it into the cooling liquid.

The present invention is furthermore concerned with a water fountain that, according to the invention, has a jet pipe for generating a fountain and comprises at the same time a spotlight, as described above, that is arranged in the same housing. The advantages of the individual configurations of a spotlight thus also apply to the water fountain.

Particularly advantageous is a water fountain in which the jet pipe forms a cooling channel in the housing for cooling the at least one spotlight comprising at least one light emitting diode. The jet pipe itself, that is either directly a part of the housing or can be inserted like a module into the housing so that a common housing is formed, absorbs by means of its wall the heat that is generated in the spotlight and dissipates it directly into the water, or into the appropriate liquid, flowing through the jet pipe. In particular in the case of fountains that are arranged in large size outdoor displays that have a high flow velocity and transport a large quantity of water through the jet pipe, a lighting unit provided with a great luminous intensity is sufficiently cooled in this way.

The water fountain arranged in a housing together with the jet pipe can project at least partially from the water so that the luminous intensity can be fully utilized. Preferably, in this connection several LED clusters are arranged radially about the jet pipe that is thus arranged at the center of the lighting unit.

Moreover, an embodiment of the invention is advantageous in which in addition to the jet pipe at least one further cooling channel extends through the housing. This cooling channel preferably communicates with the jet pipe but can also be supplied by means of a separate supply with cooling medium. The lighting unit is thus directly liquid-cooled not only immediately in the area of the jet pipe but also at a location of the spotlight remote from the jet pipe.

In a further advantageous embodiment of a water fountain the cooling channel is at least configured partially by the wall of an inner housing and an outer housing so that advantageously a circumferential angular gap can be provided. The inner housing is preferably resting against the area provided with the illumination means so that this space can be cooled at the inner side by the jet pipe and on the outer side by the annular gap and from below by the cooling channel that adjoins the angular gap.

In accordance with a further advantageous embodiment of the invention, the cooling channel passes across a water-protected electronic unit that supplies current to the LEDs or the LED clusters and controls them. For example, a bypass or a cooling channel is integrated in a potting compound through which bypass/channel the cooling medium can be guided. In this way, the heat generated in the electronic control unit that is generated in particular when using a circuit board furnished with LEDs or similar controllable illumination means is dissipated in an excellent way.

By using LEDs and LED clusters with high luminous intensity, the corresponding spotlights not only can be designed to be more compact but a water fountain by using a jet pipe in the same housing can also be sufficiently cooled. Advantageously, a three watt LED replaces a 20 watt halogen lamp wherein the service life of the LED is approximately 20,000 hrs.

In a further embodiment of the invention between the electronic control unit and the LED circuit board a metal plate can be additionally arranged that, for dissipation of heat to the outer housing wall or the jet pipe, is attached by means of a heat-conductive paste in the housing, i.e., to the circuit board and the housing wall and/or the wall of the jet pipe.

The use of a bypass or cooling channel, that extends through the potted electronic control unit via the annular gap to the exterior, enables the elimination of the heat-conducting metal plate; this leads to an especially inexpensive solution.

Furthermore, the jet pipe is advantageously provided with various inserts in order to generate water displays with different jet strengths or a plurality of water jets.

DESCRIPTION OF PREFERRED EMBODIMENTS

Identical or similarly acting parts are, if useful, identified with the same numerals.

Figure 1:
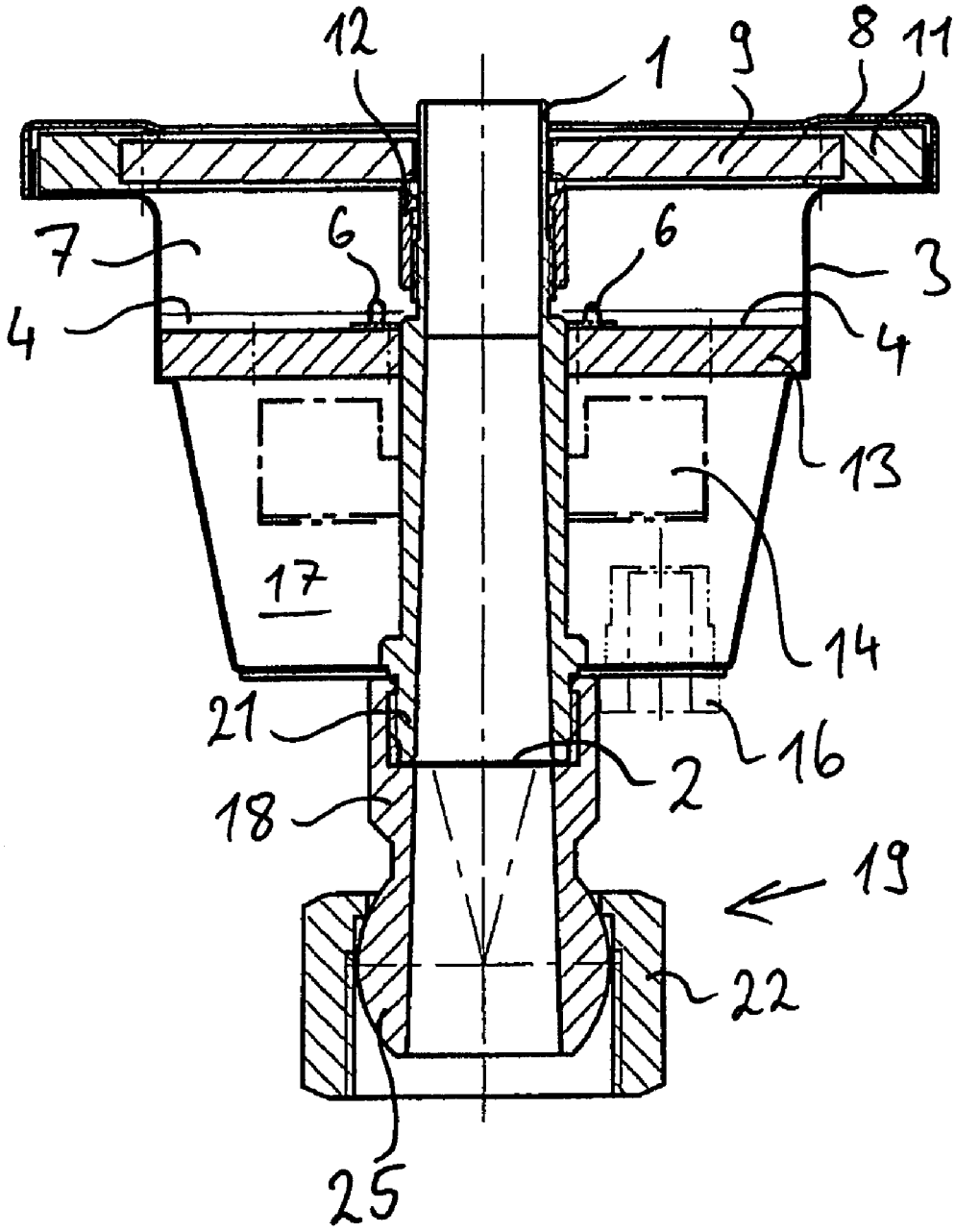
FIG. 1 shows a water fountain according to the invention in a vertical section view.

FIG. 1 shows a water fountain that has a multi-part jet pipe 1 through which water supplied by water inlet opening 2 exists in the plane of the drawing upwardly as a fountain from the jet pipe 1. The jet pipe 1 together with a spotlight is arranged in housing 3 and surrounded by it. The spotlight comprises LEDs 6 that are arranged radially about the jet pipe 1 on a circuit board 4. The LEDs 6, of which only two are shown, fill the lower area of an interior 7 of the lighting unit almost completely across the surface area so that almost across the entire cross-sectional surface area 10 illustrated in FIG. 2 illumination means are arranged that provide a lighting unit that, on the one hand, is uniform and, on the other hand, can provide different colors as a result of the variety of individual illumination means.

The light emitted by the LEDs 6 passes into the ambient through a glass lens 9 arranged in a cover 8 all around the jet generated by the jet pipe 1. Optical elements arranged additionally within the interior 7 or as a substitute for the glass lens 9 can change the jet in a targeted way, for example, focus it or scatter it. For this purpose, an electronically controlled filter element as a substitute for the glass lens 9 can be provided so that during the course of actuation of the water fountain an electronically variable beam path of the light is generated.

The cover 8 engages a seal 11 resting against the glass lens 9 with which seal the interior 7 is sealed relative to the environment. The glass lens 9 is concentrically positioned about the jet pipe 1 and is supported thereat by means of a compensation ring 12. The latter serves at the same time also a seal of the interior 7. The circuit board 4 is delimited downwardly by a metal plate 13 that preferably rests by means of a heat conductive paste against a wall of the housing 3 and inwardly against the wall of the jet pipe 1. The metal plate 13 thus distributes the heat generated by the circuit board 4 and the LEDs 6 on the one hand onto the housing 3 or its outer wall and, on the other hand, mainly to the jet pipe 1 that is generally more strongly cooled by the water passing through. Below the metal plate 13 an electronic control unit 14 is also arranged concentrically about the jet pipe 1 and is attached to it. By means of the connection of a cover of the electronic control unit 14 to the jet pipe 1 the electronic control unit is also cooled. A cable passage 16 ensures on the one hand that the cables required for the control and current supply of the LED clusters can pass through and, on the other hand, that the housing 3 is sealed relative to the exterior.

A free interior 17 provided in the illustrated embodiment of the invention can be filled with potting compound 27 for additional protection of the control unit 14.

At its lower end the jet pipe 1 is extended by a flange 18 of a ball-and-socket joint 19 that has a hollow interior. For this purpose, the inner side of the flange 18 is aligned with the inner side of a connecting flange 21 of the jet pipe 1. The socket 22 of the ball-and-socket joint 19 also has a hollow interior in order to ensure a supply of water by a conveying means such as a pump. Advantageously, the socket 22 provided with a joint flange is designed such that the ball 25 by screwing on the joint flange is securely seated in the socket 22. Depending on the configuration of the invention, additional securing means for alignment of the fountain are then not needed.

Figure 2:
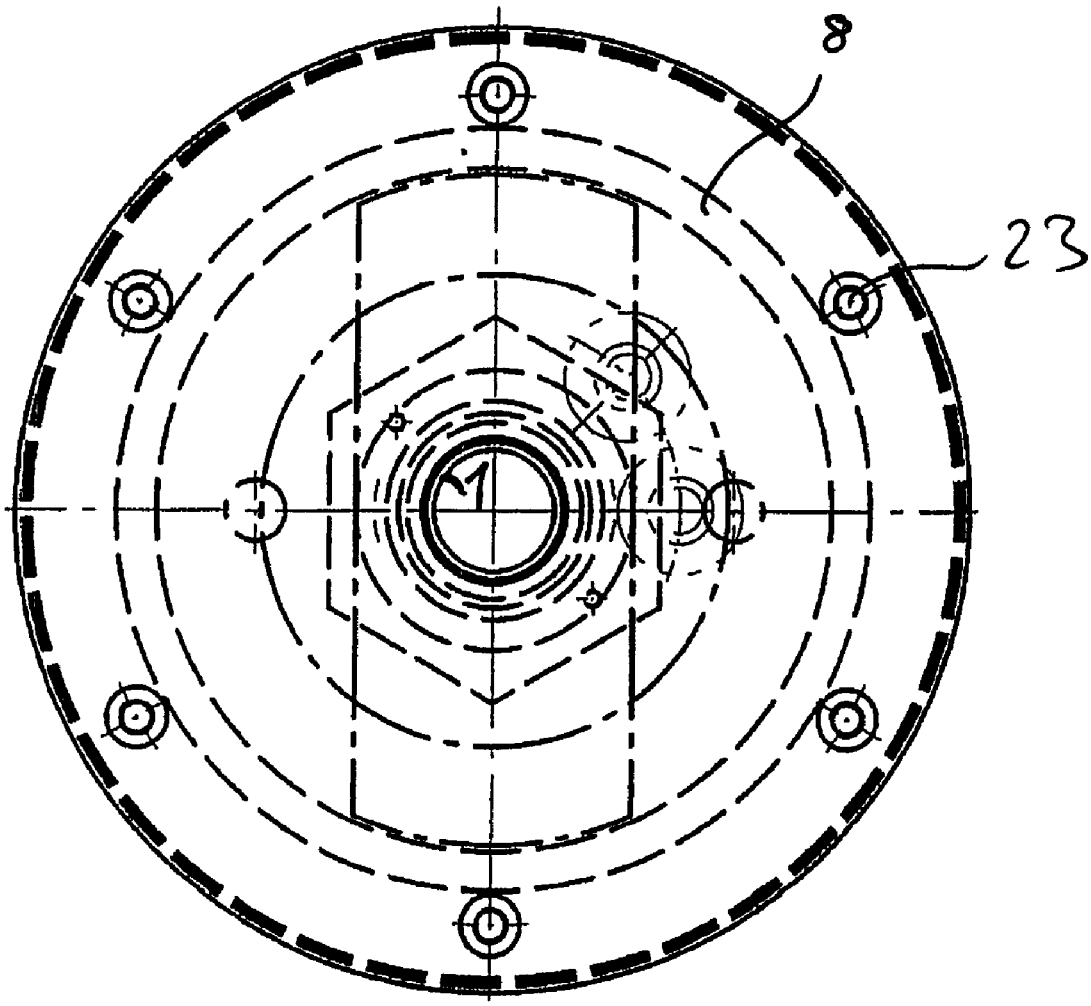
FIG. 2 is a plan view onto the object of FIG. 1.

The cover 8 screwed onto the housing 3 in accordance with FIG. 2 is additionally secured by screws 23 or similar attachment means. It is apparent that, by means of the circular cross-sectional configuration of the water fountain, the water jet exiting from the jet pipe 1 at the center of the water fountain can be illuminated circumferentially in an optimal way.

Cooling by means of the jet pipe 1 and optionally a further bypass or additional cooling channel 26 to be described in the following as well as the use of a circuit board 4 furnished with LEDs 6 provide a very compact water fountain that can be arranged also out of the water. The use of the ball-and-socket joint 19 with simultaneous supply of water enhances thus the use of the water fountain according to the invention as a basic modular component for a more complex water fountain in which spotlights according to the invention and individual water fountains according to the invention are combined to a large preferably computer-controlled water fountain system. The fountains used in this context can be illuminated well without problems up to a height of several dozen meters. Illuminations up to a height of a hundred and more meters are also possible with appropriate illumination means.

Figure 3:
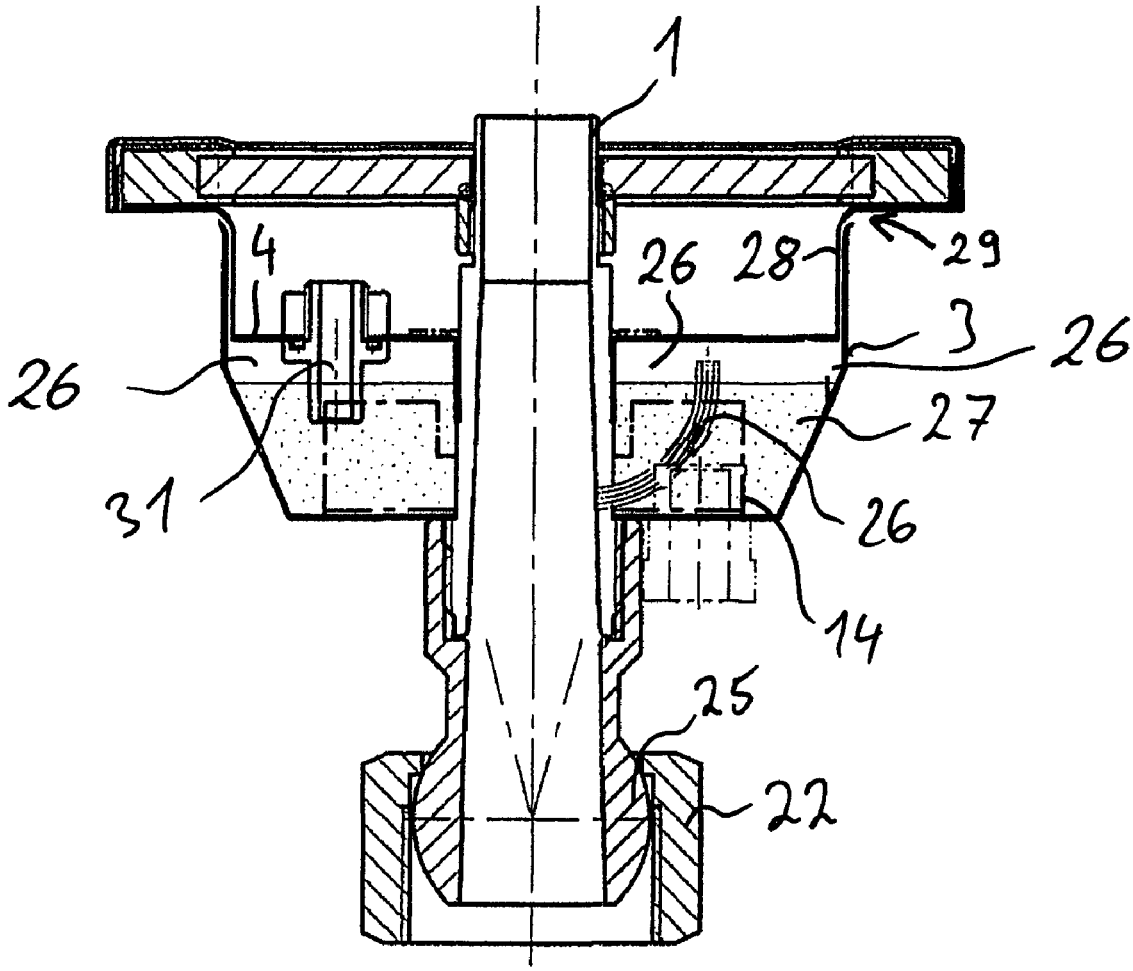
FIG. 3 shows a further water fountain according to the invention.

According to FIG. 3 the embodiment of a water fountain according to the invention illustrated therein comprises an additional cooling channel 26 that is connected to the jet pipe 1 and provides as a bypass to the water flowing mainly through the jet pipe 1; the channel passes through the potting compound 27 enclosing the control unit 14 so that the latter is cooled in operation. In addition, the housing 3 is provided with an inner housing 28 that has, at least at the edge, an annular gap 29 through which the water passing through the channel 26 and passing below the circuit board 4 for cooling is guided out of the housing 3. For safeguarding the electrical components, the control unit 14 is connected by a cable seal 31 to the circuit board 4.

Figure 4:
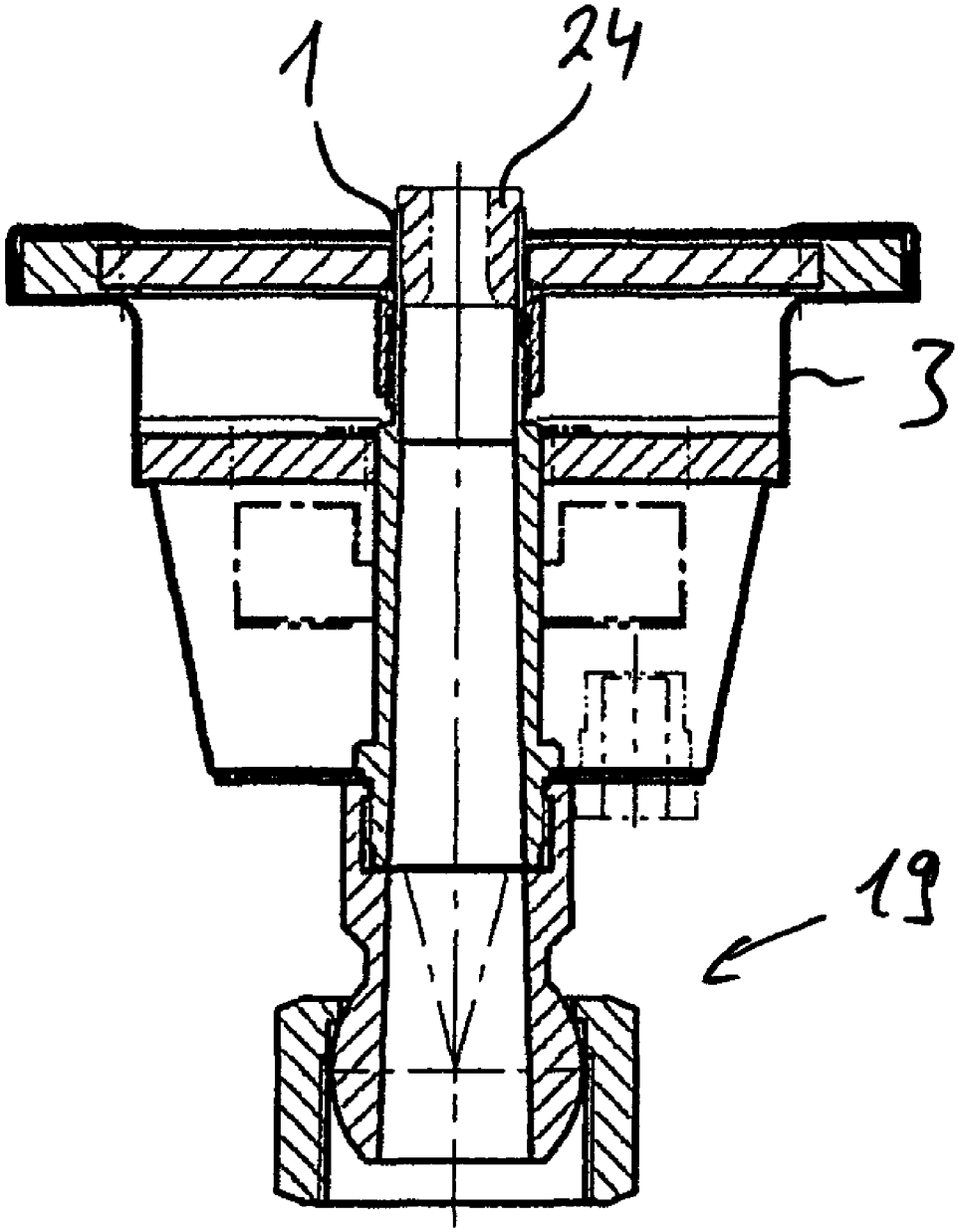
FIG. 4 shows the object of FIG. 1 with a different jet insert.
Figure 5:
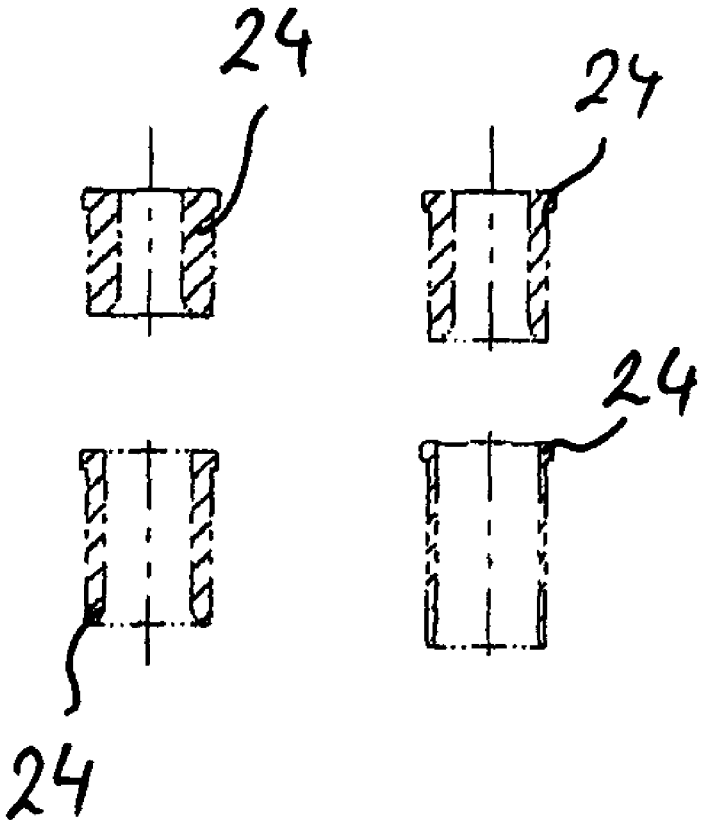
FIG. 5 shows several jet inserts for utilization in a water fountain according to the invention.

The water fountain according to the invention in accordance with FIG. 4 comprises a jet pipe 1 that comprises a jet insert 24 at its upper end for restricting the cross-section. Such a jet insert 24 is for example an exchangeable insert of a jet pipe 1 that is comprised of several parts. Possible configurations of such an insert can be seen in FIG. 5. Depending on the desired fountain, the jet inserts 24 are more or less elongate and change the cross-section.

As a whole, the water fountain according to the invention is even more compact as a result of the additional cooling action by means of the additional cooling channel 26 that passes through the potting compound 27 and optionally extends across an outer wall of the electronic control unit.

Figure 6:
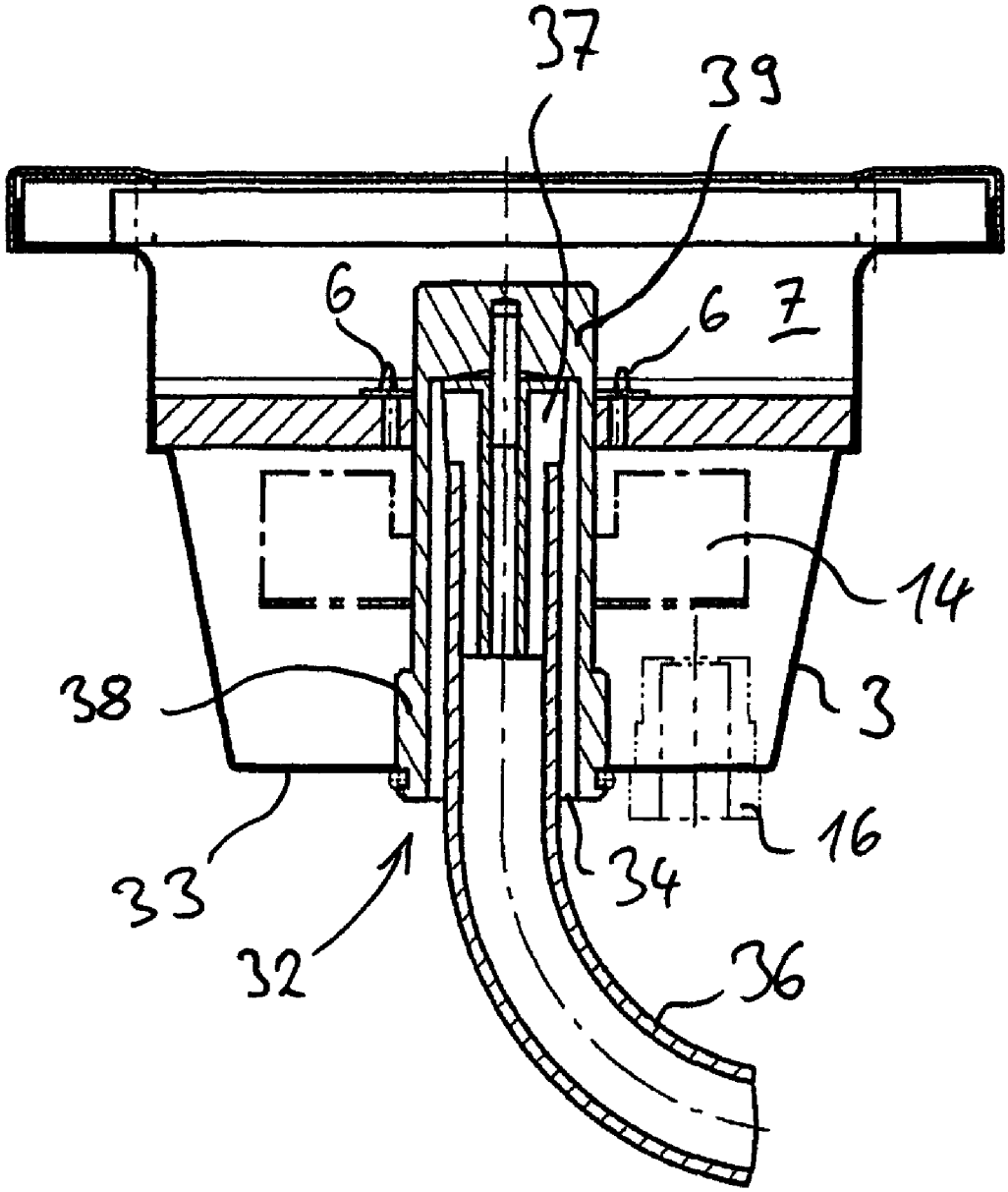
FIG. 6 shows a spotlight according to the invention.
Figure 7:
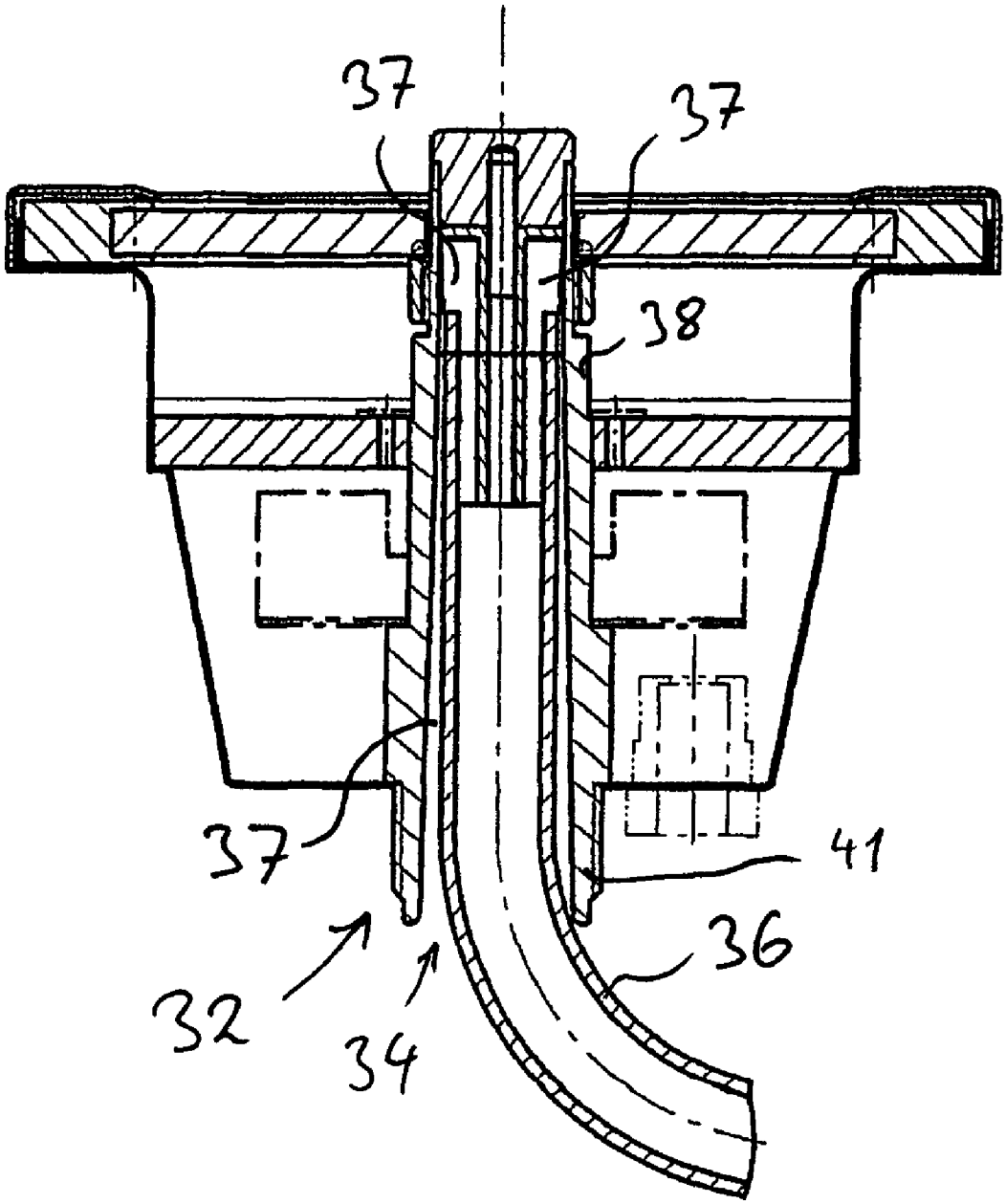
FIG. 7 shows a further embodiment of a spotlight according to the invention.

The fountain of this water fountain can be illuminated additionally by a spotlight according to the invention in accordance with FIGS. 6 and 7 with a liquid-cooled lighting unit. For this purpose, the spotlight according to the invention comprises a lighting unit comprised at least of an electronic control unit 14, circuit board 4, and LEDs 6 as well as its cover and housing 3 together with a stand to be provided. Also, a cable passage 16 for supplying the lighting unit is provided. The spotlight with its lighting unit is penetrated centrally by a cooling module 32 that is to provided by mounting. The cooling medium supply and removal are realized by inlets 2 and outlets 34 that are essentially centrally arranged approximately at the level of the lower housing wall 33 and in this way are arranged inconspicuously. Additionally, the cooling medium exiting from the outlet opening 34 covers the supply pipe 36. In this way, a visually pleasing spotlight is provided that can be aligned by means of the stationary pipe 36. Alternatively, the pipe 36 can be in the form of a flanged joint similar to the ball-and-socket joint 19 according to FIG. 3.

Advantageously, the spotlight for this purpose has a flange 41 shown in the embodiment according to FIG. 7 which flange matches substantially the attachment flange 21. When looking at FIG. 7 and FIG. 1, it can be seen that the jet pipe 1 in the spotlight according to FIG. 7 is penetrated partially by a cooling module 32 or has been replaced by it.

In this connection, the cooling module 32 has a supply path for cooling liquid or cooling medium that is embodied as a pipe 36 and a cooling medium outlet that is realized by outlet opening 34. The cooling head 39 arranged in the interior 7 in FIG. 6 and serving for cooling the interior 7 of the lighting unit is without special function in the embodiment according to FIG. 7.

The spotlight according to FIG. 7 has approximately an identical configuration compared to the spotlight of FIG. 1. Cooling of the interior 7 is realized by cooling channels 37 of the cooling module 32 that are delimited by a wall 38 that represents at the same time a boundary of the interior 7.

The specification incorporates by reference the entire disclosure of German priority document 10 2007 029 080.4 having a filing date of Jun. 21, 2007. While specific embodiments of the invention have been shown and described in detail to illustrate the inventive principles, it will be understood that the invention may be embodied otherwise without departing from such principles.

What is claimed is:

1. A water fountain comprising:

a common housing;

a jet pipe arranged in the common housing for generating a fountain;

a spotlight arranged in the common housing, wherein the spotlight has at least one liquid-cooled lighting unit that comprises a circuit board and at least one LED (light emitting diode) arranged on the circuit board in the common housing, and wherein the spotlight provides at least external illumination of the fountain;

wherein the spotlight comprises a heat-conducting plate that is a metal plate and wherein the circuit board of the at least one lighting unit is arranged on the metal plate;

wherein the metal plate is attached to a housing wall of the common housing and to the wall of the jet pipe to dissipate heat to the housing wall and to the wall of the jet pipe.

2. The water fountain according to claim 1, wherein the at least one lighting unit comprises at least one LED cluster.

3. The water fountain according to claim 1, wherein several of the at least one LED are arranged on the circuit board.

4. The water fountain according to claim 3, wherein the circuit board has a liquid-cooled side that delimits a cooling channel.

5. The water fountain according to claim 1, wherein the heat-conducting plate delimits a cooling channel.

6. The water fountain according to claim 1, further comprising a cooling module arranged in a central area of the common housing.

7. The water fountain according to claim 1, wherein the common housing has a cooling liquid inlet opening arranged in a central lower area of the common housing.

8. The water fountain according to claim 1, wherein the common housing has a cooling liquid outlet opening arranged in a central lower area of the common housing.

9. The water fountain according to claim 1, comprising a cooling head projecting into the lighting unit.

10. The water fountain according to claim 1, wherein the jet pipe forms a cooling channel within the common housing for cooling the spotlight.

11. The water fountain according to claim 1, wherein the jet pipe is arranged so as to centrally penetrate the at least one lighting unit of the spotlight and wherein the metal plate has an inner circumferential wall and an outer circumferential wall, wherein the inner circumferential wall is connected to the wall of the jet pipe and the outer circumferential wall is connected to the housing wall.

12. The water fountain according to claim 1, comprising a cooling channel arranged in the common housing, wherein the cooling channel is delimited by the at least one lighting unit of the spotlight.

13. The water fountain according to claim 12, further comprising an inner housing, wherein the cooling channel is formed partially by walls of the inner housing and the common housing that provides an outer housing.

14. The water fountain according to claim 13, wherein the cooling channel forms a circumferentially extending annular gap.

15. The water fountain according to claim 12, further comprising a water-protected electronic control unit wherein the cooling channel passes across the water-protected electronic control unit for cooling the water-protected electronic control unit.

16. The water fountain according to claim 1, comprising a ball-and-socket joint for installing the water fountain in a body of water.

17. The water fountain according to claim 1, wherein the at least one lighting unit comprises a glass lens that is penetrated by the jet pipe.

18. The water fountain according to claim 1, wherein the jet pipe is provided with an exchangeable jet insert.

19. The water fountain according to claim 1, wherein the at least one lighting unit comprises several LED clusters arranged radially about the jet pipe.

20. The water fountain according to claim 1, comprising at least one additional jet pipe penetrating the at least one lighting unit.

* * * * *